US010263357B2

(12) United States Patent
Herbrechtsmeier et al.

(10) Patent No.: US 10,263,357 B2
(45) Date of Patent: Apr. 16, 2019

(54) HOLDING FRAME WITH RESTORING FORCE FOR PLUG CONNECTOR MODULES

(71) Applicant: HARTING Electric GmbH & Co. KG, Espelkamp (DE)

(72) Inventors: Heiko Herbrechtsmeier, Bunde (DE); Heiko Meier, Minden (DE); Alexander Schonfeld, Osnabruck (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/756,897

(22) PCT Filed: Aug. 16, 2016

(86) PCT No.: PCT/DE2016/100366
§ 371 (c)(1),
(2) Date: Mar. 1, 2018

(87) PCT Pub. No.: WO2017/036445
PCT Pub. Date: Mar. 9, 2017

(65) Prior Publication Data

US 2018/0248297 A1 Aug. 30, 2018

(30) Foreign Application Priority Data

Sep. 3, 2015 (DE) ..... 10 2015 114 699

(51) Int. Cl.
*H01R 13/502* (2006.01)
*H01R 13/506* (2006.01)
(Continued)

(52) U.S. Cl.
CPC ..... *H01R 13/506* (2013.01); *H01R 13/508* (2013.01); *H01R 13/514* (2013.01); *H01R 13/518* (2013.01)

(58) Field of Classification Search
CPC ..... H01R 13/514; H01R 9/26; H01R 13/518; H01R 23/025
(Continued)

(56) References Cited

U.S. PATENT DOCUMENTS 3,160,280 A 12/1964 Burch
4,693,440 A 9/1987 Lalonde
(Continued)

FOREIGN PATENT DOCUMENTS

CN 201656162 U 11/2010
CN 202084755 U 12/2011
(Continued)

OTHER PUBLICATIONS

German Office Action, dated Aug. 10, 2016, for German Application No. 10 2015 114 699.1, 4 pages (no English translation provided).
(Continued)

*Primary Examiner* — Phuong Chi T Nguyen
(74) *Attorney, Agent, or Firm* — Seed IP Law Group LLP

(57) ABSTRACT

The disclosure relates to a holding frame, into which plug-in connector modules can be inserted, wherein the holding frame is composed of two halves connected to each other, a first half and a second half, wherein, for the purpose of opening the holding frame, the halves can be brought into an angular position less than 180°. The holding frame has at least one spring element that exerts a restoring force upon the halves, as a result of which lateral parts of the holding frame are brought back into a substantially parallel orientation in relation to each other.

10 Claims, 4 Drawing Sheets

(51) Int. Cl.
*H01R 13/508* (2006.01)
*H01R 13/518* (2006.01)
*H01R 13/514* (2006.01)

(58) Field of Classification Search
USPC ..... 439/701, 716, 532, 540.1
See application file for complete search history.

(56) References Cited

U.S. PATENT DOCUMENTS

| | | | | |
|---|---|---|---|---|
| 5,529,426 | A | 6/1996 | Masuda et al. | |
| 5,829,910 | A | 11/1998 | Kameyama | |
| 6,004,162 | A | 12/1999 | Harting et al. | |
| 6,196,869 | B1 | 3/2001 | Kay et al. | |
| 6,350,141 | B1 | 2/2002 | Houtz | |
| 6,692,310 | B2 | 2/2004 | Zaderej et al. | |
| 6,913,487 | B2 * | 7/2005 | Beneke | H01R 13/514 439/607.01 |
| 7,066,677 | B2 | 6/2006 | Rüter | |
| 7,316,591 | B2 * | 1/2008 | Ferderer | H01R 13/506 439/532 |
| 7,753,701 | B2 | 7/2010 | Tsuji | |
| 7,896,694 | B2 | 3/2011 | Schumann et al. | |
| 8,292,676 | B2 | 10/2012 | Schmidt et al. | |
| 8,449,314 | B1 | 5/2013 | Feist et al. | |
| 8,668,530 | B2 | 3/2014 | Riepe et al. | |
| 8,821,186 | B2 | 9/2014 | Lan | |
| 8,979,568 | B2 | 3/2015 | Herbrechtsmeier et al. | |
| 9,502,813 | B2 | 11/2016 | Dugo | |
| 9,577,365 | B1 | 2/2017 | Herbrechtsmeier et al. | |
| 9,608,374 | B2 | 3/2017 | Beischer et al. | |
| 9,847,608 | B2 | 12/2017 | Bruex et al. | |
| 9,880,357 | B2 * | 1/2018 | Drescher | G02B 6/32 |
| 9,923,307 | B2 | 3/2018 | Beischer et al. | |
| 10,050,391 | B2 * | 8/2018 | Herbrechtsmeier | H01R 13/506 |
| 2005/0070146 | A1 | 3/2005 | Lu | |
| 2006/0035501 | A1 | 2/2006 | Lewis et al. | |
| 2007/0155252 | A1 | 7/2007 | Ferderer | |
| 2010/0159728 | A1 | 6/2010 | Wang et al. | |
| 2014/0179171 | A1 | 6/2014 | Mortun et al. | |
| 2018/0026405 | A1 | 1/2018 | Schlepp et al. | |
| 2018/0241149 | A1 | 8/2018 | Herbrechtsmeier et al. | |
| 2018/0248296 | A1 | 8/2018 | Herbrechtsmeier et al. | |
| 2018/0248298 | A1 | 8/2018 | Schönfeld et al. | |
| 2018/0254576 | A1 | 9/2018 | Herbrechtsmeier et al. | |
| 2018/0254577 | A1 | 9/2018 | Herbrechtsmeier et al. | |
| 2018/0254578 | A1 | 9/2018 | Herbrechtsmeier et al. | |
| 2018/0269621 | A1 | 9/2018 | Schönfeld | |
| 2018/0277978 | A1 | 9/2018 | Schönfeld et al. | |

FOREIGN PATENT DOCUMENTS

| | | | |
|---|---|---|---|
| CN | 202352910 | U | 7/2012 |
| CN | 20 2013 103 611 | U1 | 11/2013 |
| CN | 104466562 | A | 3/2015 |
| CN | 204205152 | U | 3/2015 |
| CN | 204271392 | U | 4/2015 |
| DE | 197 07 120 | C1 | 6/1998 |
| DE | 197 45 384 | A1 | 4/1999 |
| DE | 20 2005 020 026 | U1 | 4/2006 |
| DE | 20 2012 103 360 | U1 | 3/2013 |
| DE | 10 2013 106 279 | A1 | 12/2014 |
| DE | 10 2015 101 433 | B3 | 6/2016 |
| EP | 0 843 384 | A2 | 5/1998 |
| EP | 2 581 991 | A2 | 4/2013 |
| FR | 2 860 348 | A1 | 4/2005 |
| GB | 1 394 867 | A | 5/1975 |
| WO | 2014/155171 | A1 | 10/2014 |

OTHER PUBLICATIONS

International Search Report and Written Opinion, dated Nov. 21, 2016, for International Application No. PCT/DE2016/100366, 11 pages (with English translation of Search Report).
Harting Elektronik GmbH, "Schwere Steckverbinder Han-Modular®," Product Catalog, Jan. 1999, 44 pages.
International Preliminary Report on Patentability, dated Mar. 6, 2018, for International Application PCT/DE2016/100366, 13 pages. (with English Translation).
Written Opinion of the International Search Authority, dated Nov. 21, 2016, for International Application No. PCT/DE2016/100366, 5 pages. (English Translation).

* cited by examiner

HOLDING FRAME WITH RESTORING FORCE FOR PLUG CONNECTOR MODULES

BACKGROUND

Technical Field

The disclosure relates to a holding frame for plug-in connector modules.

Such holding frames serve to hold plug-in connector modules, wherein the holding frame is equipped with various plug-in connector modules and then inserted in a plug-in connector housing and screw-connected to the latter. The holding frame in this case must be mechanically stable in order to be able to withstand the insertion and withdrawal forces that occur as the plug-in connection is fitted together and disconnected.

Description of the Related Art

A holding frame for plug-in connector modules is known from DE 197 07 120 C1. The holding frame is composed of two halves, which are connected to each other via a hinged joint. Latching hooks of the plug-in connector modules engage in recesses of the lateral surfaces of the respective half. The hinged joint, or the end hinged joints, are disposed in the fastening ends of the holding frame. When the holding frame is being screw-connected onto a fastening surface, the frame parts are oriented in such a manner that the lateral parts of the holding frame are oriented at right angles to the fastening surface. The plug-in connector modules are thereby fixed in the holding frame.

The holding frame of DE 197 07 120 C1 does not have a definitely defined open position for equipping the holding frame with plug-in connector modules. This occasionally results in a somewhat cumbersome assembly, particularly in the case of inexpert personnel.

When the holding frame has been successfully equipped with plug-in connector modules, it must be brought into a closed state, or into a closed position, so that the plug-in connector modules are fixed. For the closed state of the holding frame of the prior art, there is no fixed closed state, such that the holding frame may open accidentally, as a result of which the modules may fall out of their anchorage.

A pure hinged contact does not always provide a defined electrical contact between the halves of the holding frame. As a result, reliable use of the holding frame for grounding purposes cannot be ensured.

CN 204 205 152 U discloses a holding frame for plug-in connector modules. The holding frame is composed of two halves, which are connected to each other and the respective ends via helical springs. The halves are drawn toward each other longitudinally by the helical springs. When the holding frame is being equipped with plug-in connector modules, it is necessary to ensure that the ends of the holding frames are equidistant from each other, to enable easy insertion of the plug-in connector modules. Furthermore, when the halves are being drawn back, it must be ensured that the ends are drawn back in an equally parallel manner, since otherwise the modules become caught in the lateral parts of the halves.

Overall, the equipping process of CN 204 205 152 U is very cumbersome, and frequently results in the plug-in connector modules becoming jammed or caught.

BRIEF SUMMARY

Embodiments of the present invention provide a holding frame that is easy to manipulate and that has a multiplicity of diverse applications.

The holding frame disclosed here is designed to be equipped with so-called plug-in connector modules and to be fitted into a plug-in connector housing, or a device wall. The holding frame has two halves that can be connected to each other, a first half and a second half, and at least one first spring element. The halves each have lateral parts.

The longitudinal sides of the halves form a parting plane. Along this parting plane, the halves may assume an angle $\alpha$ in relation to each other. If the angle is less than 180°, the holding frame is changed over to an open position. For this purpose, it is necessary to work against a spring force of the spring element. The first spring element exerts a restoring force upon the halves, as a result of which the lateral parts of the holding frame tend toward a substantially parallel orientation in relation to each other. In this case, the above-mentioned angle is approximately 180°.

As already mentioned above, the lateral parts of the halves are oriented substantially parallel to each other by the restoring force. The restoring force acts upon the halves in the direction of the closed position.

The holding frame can be opened, so that plug-in connector modules can be inserted therein. To open the holding frame, the lateral parts are brought into an angular position ($\alpha$) less than 180° in relation to each other. Upon closing of the holding frame, the lateral parts are again brought back into a parallel position in relation to each other. This rotative movement, assisted by the spring element, does not cause the inserted plug-in connector modules to become caught or canted. The halves are oriented into the closed position by the restoring force.

If the spring element additionally has a fixing element, the halves can be oriented into and fixed in at least two positions in relation to each other.

By way of the fixing element, the holding frame may optionally be fixed in an open position or in a closed position. In the open position, the holding frame can be fitted with plug-in connector modules. In the closed position, the plug-in connector modules can no longer slip or fall out.

Preferably, the spring element has an Omega-shaped, or substantially Omega-shaped, basic form, wherein there are laterally projecting holding arms formed on the basic form. The spring element is fixed to the halves by the holding arms. In addition, there may be an outwardly oriented fixing element formed on the basic form. The fixing element and the laterally projecting holding arms lie in one plane and are oriented approximately perpendicularly in relation to each other. Such a spring element can be produced inexpensively from a sheet metal material by a punching and bending technique.

Advantageously, there are two latching springs formed on the fixing element of the spring element. There are two outwardly oriented recesses made, respectively, in an end face of each half of the holding frame. One latching spring can be made to engage in the two recesses of the first half, and the other latching spring can be made to engage in the two recesses of the second half, as a result of which the holding frame can be fixed in the open position or in the closed position. This type of fixing can be realized in a manner that is technically particularly simple and particularly operator-friendly.

In a particularly advantageous embodiment of the invention, the halves each have an opening at an end face. The openings are substantially mirror-symmetrical, and oriented toward each other. The openings together form a receiver, into which the spring element is fixed. In this case, the bent basic form of the spring element effects a hinged connection of the two halves, as is realized in an elaborate manner in the prior art by a hinged joint head having a corresponding hinged joint receiver. The hinged connection proposed here is considerably easier to produce.

Preferably, the holding frame has a second spring element, and the first spring element and the second spring element are of identical structural design. The spring elements are located on the respective end faces of the joined halves. Two spring elements render the holding frame considerably more stable in its functioning.

The ability to adjust the orientation of the holding frame is achieved by the hinged connection of the two halves of the holding frame. The ability to effect fixing is achieved by the spring element or spring elements. The interaction of a hinged connection and the ability to be fixed in two positions renders the holding frame particularly operator-friendly. The spring element proposed here performs a double function, in that it provides the hinged connection and the fixing.

By way of the spring element, the two halves are reliably brought into electrical contact with each other. This is effected, on the one hand, by the spring element itself, if it is made of an electrically conductive material. Moreover, owing to the biasing of the spring element, the hinged joint head of one half, when provided, is pressed into the hinged joint receiver, when provided, of the other half, as a result of which a reliable electrical contact is produced.

In the present disclosure, the terms open or closed state and open or closed position are used synonymously.

BRIEF DESCRIPTION OF THE SEVERAL VIEWS OF THE DRAWINGS

Exemplary embodiments of the invention are represented in the drawings and explained in greater detail in the following. In the drawings.

The figures are in part simplified, schematic representations. In some cases identical references are used for elements that are alike, but not identical. Differing views of the same elements may differ in scale.

DETAILED DESCRIPTION

Figure 1:
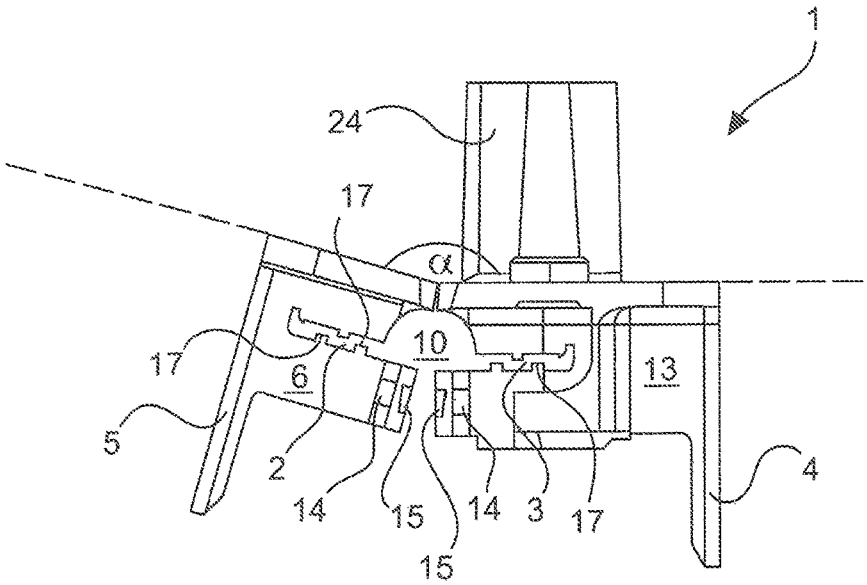
FIG. 1 shows a side view of two joined halves of a holding frame, without a spring element.

FIG. 1 shows two halves, 4, 5, a first half 4 and a second half 5, of a hinged holding frame 1, wherein the longitudinal sides of the halves 4, 5 form a parting plane. Along this parting plane the halves 4, 5 may assume an angle α in relation to each other.

Figure 2:
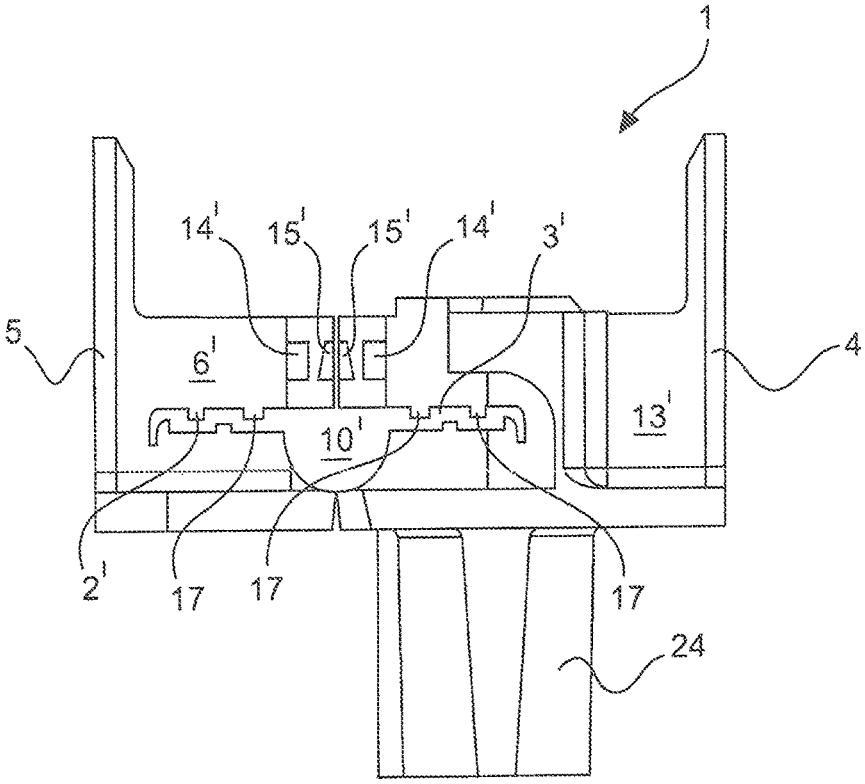
FIG. 2 shows a further side view of two joined halves of a holding frame, without a spring element.

In FIGS. 1 and 2, the direction of view is toward respective end faces, a first end face 6, 6' and a second end face 13, 13', of the holding frame 1.

An open position means that, along the parting line, the halves 4, 5 are at an angle α in relation to each other that is other than 180°. Preferably, the angle is between 130° and 170°. An angle between 155° and 165° has proved to be particularly advantageous. In this angular position of the halves 4, 5, the plug-in connector modules 19 can be inserted particularly easily into the holding frame 1. In the closed position, the halves 4, 5 assume an angle of approximately 180°, or precisely 180°, in relation to each other. Thus, in the closed position, the halves 4, 5 are parallel to each other.

At the end faces, the halves 4, 5 each have an opening, a first opening 2, 2' and a second opening 3, 3', wherein the openings 2, 2', 3, 3' in each case together form a receiver 10, 10', into which the spring element 7, 7' is fixed. The holding frame 1 shown here has a receiver 10, 10' on both sides for a respective spring element 7, 7'.

Formed in the openings 2, 2', 3, 3' are inwardly oriented teeth 17, by way of which the holding arms 9, 9' of the spring element 7, 7' can be clamped. The spring element 7, 7' is thereby held in the receiver 10, 10'.

Figure 5:
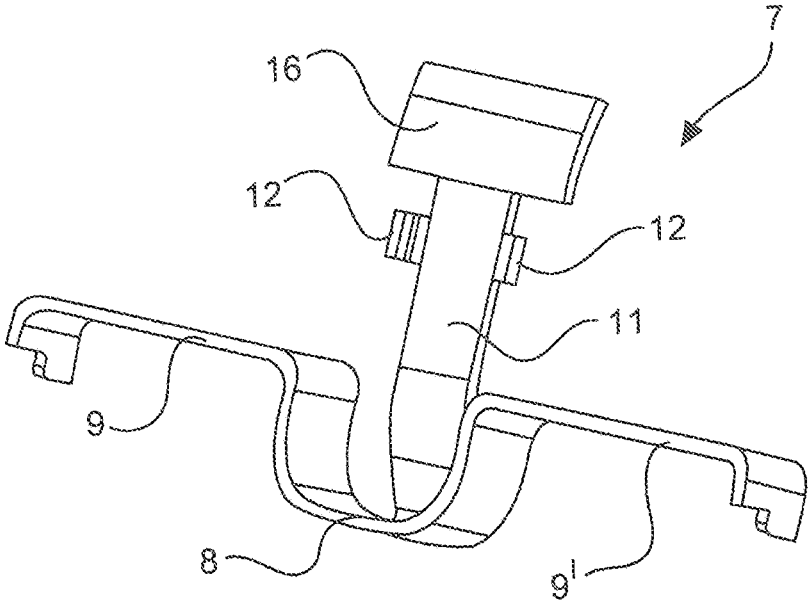
FIG. 5 shows a perspective representation of a spring element.
Figure 6:
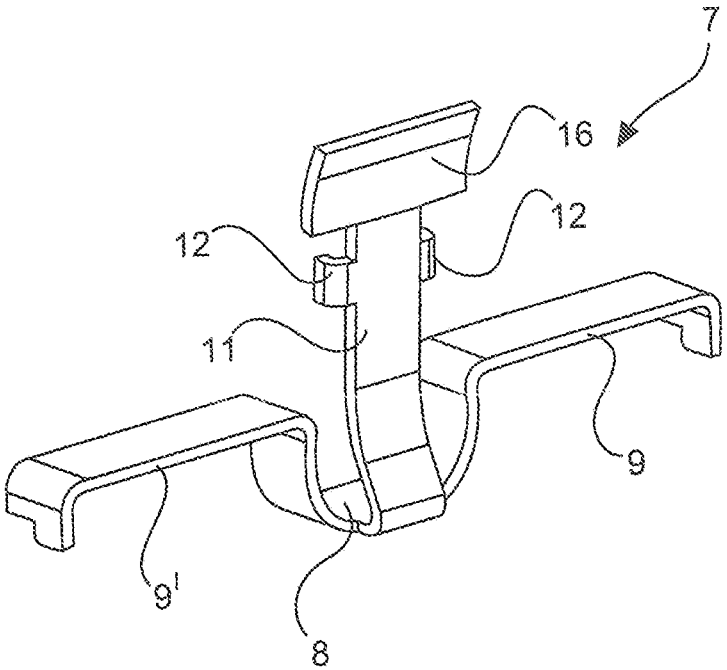
FIG. 6 shows a further perspective representation of the spring element.

FIGS. 5 and 6 show perspective representations of the spring element 7, which is fixed in the receiver 10 of the holding frame 1. The spring element 7 has a substantially Omega-shaped basic form 8. Formed on the basic form 8 there are laterally projecting holding arms 9, 9'. The holding arms 9, 9' are bent downward at the ends. Formed on the basic form 8 there is an upwardly facing fixing element 11. Formed approximately centrally on the fixing element 11 of the spring element 7 there are two external latching springs 12.

Each end face 6, 6', 13, 13' of the halves 4, 5 has respectively two outwardly facing recesses 14, 14', 15, 15', an inner recess 14, 14' and an outer recess 15, 15'. The spring element 7 is shaped such that the latching springs 12 can engage in the recesses 14, 14', 15, 15' of the halves 4, 5. When the latching springs 12 are in the inner recesses 14, 14', the holding frame 1 is fixed in a closed position. When the latching springs 12 are in the outer recesses 15, 15', the holding frame 1 is fixed in an open position, and can be equipped with plug-in connector modules 19 (FIGS. 3 and 4).

Formed on the fixing element 11, in order to release the respective position again, there is an actuation piece 16. By way of the latter, the latching springs 12 can be drawn away from the end faces 6, 6', 13, 13' of the halves 4, 5, as a result of which the latching springs 12 are drawn out of the engagement of the recesses 14, 14', 15, 15'. The halves 4, 5 can then be brought into another position in relation to each other.

The Omega-shaped basic form 8 is of an elastic design, and acts as the hinged connection of the halves 4, 5. The restoring force of this basic form 8 ensures that the halves 4, 5 are in principle forced into the closed position of the holding frame 1.

Figure 3:
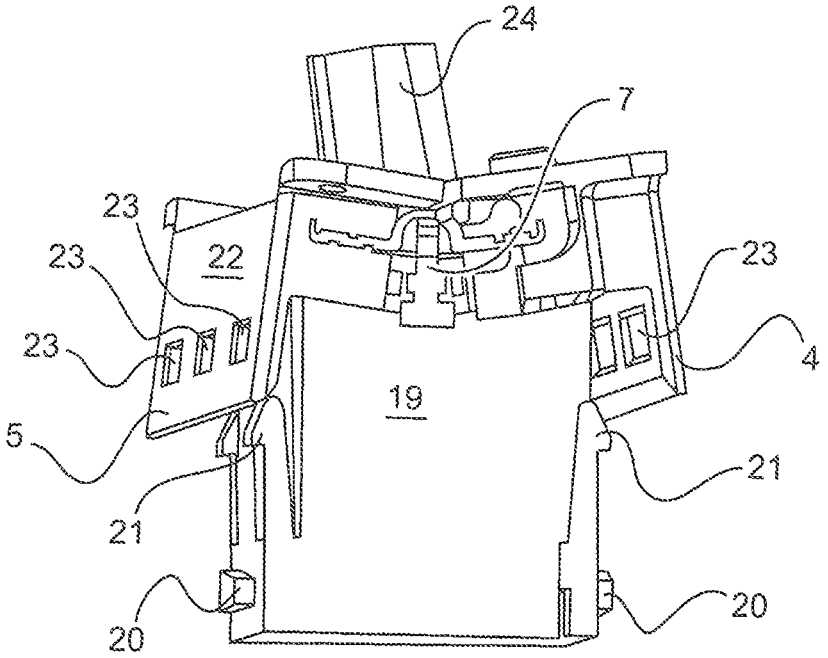
FIG. 3 shows a perspective representation of a holding frame in an opened position.
Figure 4:
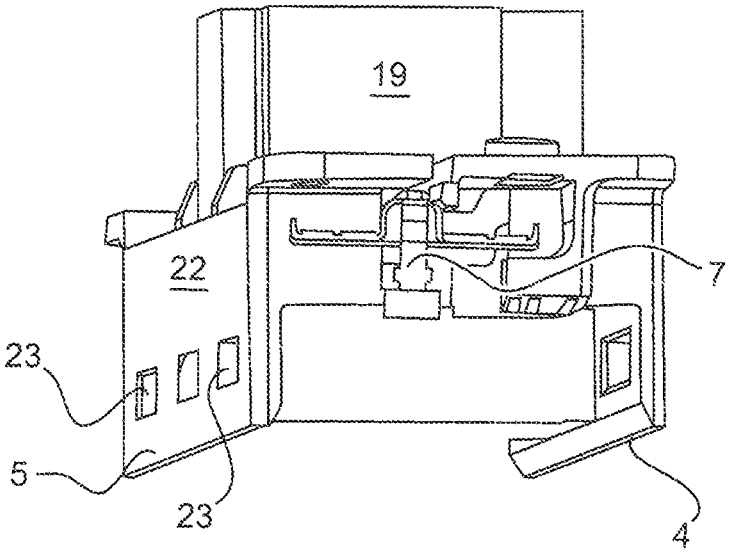
FIG. 4 shows a perspective representation of the holding frame in a closed position.

FIG. 3 shows the holding frame 1 is an opened position. There is a spring element 7 fixed into the recess 10.

Plug-in connector modules 19 have long been known, and are described, for example, in DE 197 07 120 C1. The plug-in connector modules 19 are provided with projecting, approximately rectangular holding means 20 (e.g., lugs, projections) and elastic latching hooks 21. Provided in the lateral parts 22 of the halves 4, 5 are recesses 23, realized as openings that are closed on all sides, into which the holding means 20 extend when the plug-in connector modules 19 are inserted into the holding frame 1.

For the purpose of fitting the plug-in connector modules 19, the holding frame 1, as described above, is brought into an opened position, such that the plug-in connector modules 19 can be inserted. For the purpose of pre-fixing the plug-in connector modules 19, during insertion the latching hooks 21 first engage beneath the lower edges of the lateral parts 22 of the halves 4, 5.

Then, as described above, the frame halves 4, 5 are brought into a closed position, wherein the holding means 20 extend into the recesses 23, causing the plug-in connector modules 19 to be held in the holding frame 1 in a secure, form-fitting manner.

For reasons of clarity, only one plug-in connector module 19 is shown in FIGS. 3 and 4, although there are three so-called locations.

The holding frame 1 has a grounding sleeve 24, in which a pin (not shown) of a holding frame opposite (not shown) can engage.

Figure 7:
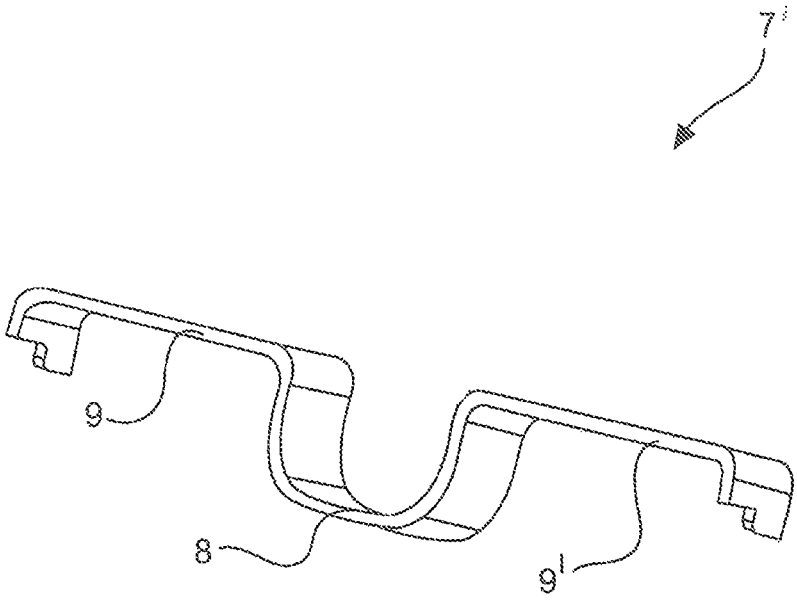
FIG. 7 shows a perspective representation of an alternative embodiment of a spring element.

An alternative variant of the spring element 7' is shown in FIG. 7. The spring element 7' represented in FIG. 7 does not have a fixing element by which the holding frame 1 can be fixed in two positions. In this case, the holding frame 1 is held in a closed position only by the restoring force generated by the spring element 7'. This force, however, is sufficient for the plug-in connector modules 19 not to fall out of the holding frame 1 after having been fitted. In order to open the holding frame 1, it is necessary to work against the restoring force of the spring element 7'.

Figure 8:
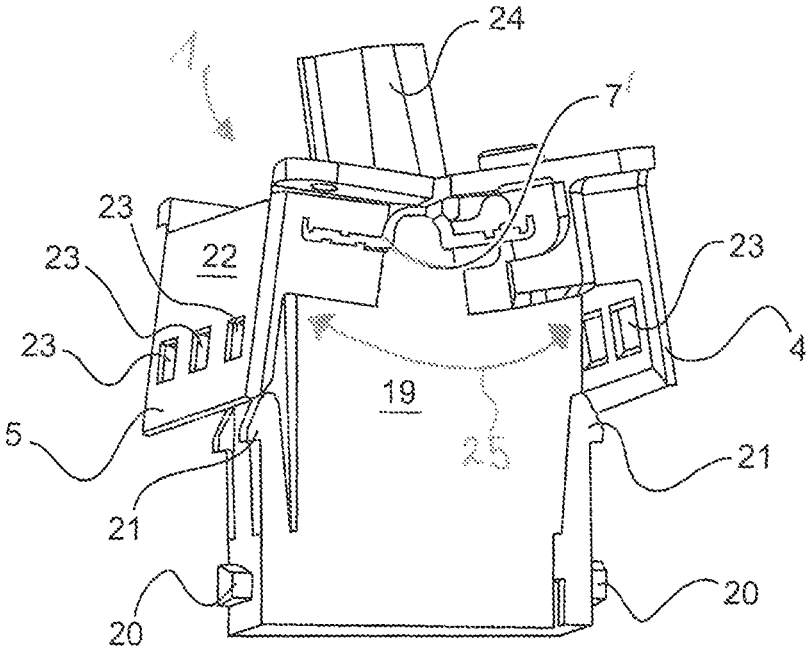
FIG. 8 shows a perspective representation of the holding frame in an opened position, with the alternative spring element.

In FIG. 8, the direction of view is toward the respective end faces 6, 6', 13, 13' of the holding frame 1. The holding frame 1 can be bent into an open position, contrary to a spring force that is provided by the spring element 7' and that is indicated by the double arrow 25. An open position means that the halves 4, 5, along the parting line, are at an angle $\alpha$ in relation to each other that is other than 180°. Preferably, the angle is between 130° and 170°. An angle between 155° and 165° has proved to be particularly advantageous. In this angular position of the halves 4, 5, the plug-in connector modules 19 can be inserted particularly easily into the holding frame 1.

In the absence of further work contrary to the restoring force, the halves 4, 5 are automatically brought back into the closed position. In the closed position, the halves 4, 5 assume an angle of approximately 180°, or precisely 180°, in relation to each other. Thus, in the closed position, the halves 4, 5 are parallel to each other. Also, in the closed position, the lateral parts 22 of the halves 4, 5 are oriented parallel to each other.

At end faces, the halves 4, 5 each have an opening 2, 2', 3, 3', wherein the openings 2, 2', 3, 3' in each case together form a receiver 10, 10', into which the spring element 7, 7' is fixed. The holding frame 1 shown here has a receiver 10, 10' on both sides for a spring element 7, 7'.

For the purpose of equipping, the holding frame 1 is first opened, in that the halves 4, 5 are manually bent, along the parting plane, into an opened position. For this purpose, the halves 4, 5 assume an angular position of less than 180° in relation to each other. The plug-in connector modules 19 are then inserted into the holding frame 1. By the insertion of a plug-in connector module 19, the halves 4, 5 can be fixed in the open position. As soon as the locking action of the plug-in connector module or the manual force is removed, the lateral parts 22 of the halves 4, 5 move, as a result of the restoring force of the spring element 7, 7', into a substantially parallel position, as a result of which the plug-in connector modules 19 become fixed in the holding frame 1. The holding frame 1 is then screwed into a plug-in connector housing or into a mounting flange (neither of which are shown).

To enable the equipping of the holding frame 1 with plug-in connector modules 19, described above, to be performed without difficulty, it may be advantageous for the upper edges of the lateral parts 22 to be slightly beveled, in order that the plug-in connector modules 19 can be pressed from above into the holding frame.

To reiterate, embodiments of the present invention relate to a holding frame (1), into which plug-in connector modules (19) can be inserted, wherein the holding frame (1) is composed of two halves (4, 5) that can be connected to each other, a first half (4) and a second half (5), wherein, for the purpose of opening the holding frame (1), the halves (4, 5) can be brought into an angular position ($\alpha$) less than 180°. The holding frame (1) has at least one spring element (7, 7'), wherein the spring element (7, 7') exerts a restoring force upon the halves (4, 5), as a result of which the lateral parts (22) of the holding frame (1) are brought back into a substantially parallel orientation in relation to each other.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame, into which plug-in connector modules can be inserted, wherein the holding frame is composed of two halves connected to each other, a first half and a second half, wherein longitudinal sides of the halves realize a parting plane, wherein the halves assume an angle in relation to each other along this parting plane, wherein the holding frame assumes an open position if the angle is less than 180°, and the holding frame assumes a closed position if the angle is approximately or equal to 180°, and wherein the holding frame has at least one spring element that exerts a restoring force, in a direction of the closed position, upon the halves.

2. The holding frame as claimed in claim 1, wherein the halves can be oriented into at least two positions in relation to each other and can be fixed in the at least two positions in relation to each other.

3. The holding frame as claimed in claim 1, wherein the spring element has a substantially Omega-shaped basic form, and wherein there are laterally projecting holding arms formed on the basic form.

4. The holding frame as claimed in claim 3, wherein formed on the basic form of the spring element there is a fixing element, which is oriented substantially perpendicularly in relation to the holding arms.

5. The holding frame as claimed in claim 4, wherein:

there are two latching springs formed on the fixing element of the spring element, at least one end face of each half of the holding frame has respectively two recesses, an inner recess and an outer recess, and one latching spring can be made to engage in the two recesses of the first half, and the other latching spring can be made to engage in the two recesses of the second half, as a result of which the holding frame can be fixed in the open position or in the closed position.

6. The holding frame as claimed in claim 1, wherein:

each of opposing end faces of each half of the holding frame has respectively two recesses, an inner recess and an outer recess, one latching spring of the spring element can be made to engage in the two recesses in one of the opposing end faces of the first half, and another latching spring of the spring element can be made to engage in the two recesses in a corresponding one of the opposing end faces of the second half, one latching spring of a second spring element can be made to engage in the two recesses in the other one of the opposing end faces of the first half, and another latching spring of the second spring element can be made to engage in the two recesses in the other one of the opposing end faces of the second half, and as a result of which the holding frame can be fixed in the open position or in the closed position.

7. The holding frame as claimed in claim 1, wherein the halves each have an opening at an end face thereof, wherein the openings together form a receiver, into which the spring element is fixed.

8. The holding frame as claimed in claim 1, wherein the holding frame has a second spring element, and the first spring element and the second spring element are of differing or identical structural design.

9. The holding frame as claimed in claim 1, wherein the parting plane is parallel to the longitudinal sides of the halves.

10. The holding frame as claimed in claim 1, the halves are composed of a metallic material, and when in a closed state are in electrically conductive contact with each other.

* * * * *